US005586695A

United States Patent [19]

Labus et al.

[11] Patent Number: 5,586,695

[45] Date of Patent: Dec. 24, 1996

[54] SPRAYED LIQUID DISPENSING APPARATUS

[76] Inventors: Rainer H. Labus, 811 E. Grinnell Dr., Burbank, Calif. 91501; Stephen L. Tucker, 227 Poinsettia, Corona Del Mar, Calif. 92625

[21] Appl. No.: 398,971

[22] Filed: Mar. 6, 1995

Related U.S. Application Data

[63] Continuation-in-part of Ser. No. 13,959, Oct. 7, 1993, Pat. No. Des. 357,177.

[51] Int. Cl.[6] ..... B65D 83/14

[52] U.S. Cl. ..... 222/396; 222/394; 222/400.7; 222/402.1

[58] Field of Search ..... 222/394, 396, 222/400.7, 402.1, 635

[56] References Cited

U.S. PATENT DOCUMENTS

| | | | |
|---|---|---|---|
| 44,873 | 10/1864 | Lyndc . | |
| 1,648,575 | 8/1923 | Campbell . | |
| 1,832,570 | 11/1931 | Montgomery . | |
| 2,092,596 | 9/1937 | Ward | 215/4 |
| 2,331,117 | 10/1943 | Goodhuc et al. | 299/95 |
| 2,841,190 | 7/1958 | Scheck et al. | 141/20 |
| 2,995,009 | 8/1961 | Rush | 60/35.6 |
| 3,064,696 | 11/1962 | Gruenewald | 141/20 |
| 3,259,194 | 7/1966 | McCrossan | 222/394 X |
| 3,324,903 | 6/1967 | Hinz | 141/17 |
| 3,365,105 | 1/1968 | Krizka | 222/394 |
| 3,491,918 | 1/1970 | Lucas | 222/193 |
| 3,563,419 | 2/1971 | Coerver, Jr. et al. | 222/193 |
| 3,718,236 | 2/1973 | Reyner et al. | 202/386 |
| 4,019,657 | 4/1977 | Spitzer et al. | 222/136 |
| 4,093,123 | 6/1978 | Maran | 239/322 |
| 4,530,450 | 7/1985 | Nandagiri | 222/402.1 |
| 4,613,531 | 9/1986 | Gokcen et al. | 428/35 |
| 4,709,831 | 12/1987 | Coplan | 220/304 |
| 4,782,982 | 11/1988 | Ellison | 222/1 |
| 4,819,838 | 4/1989 | Hart, Jr. | 222/538 |
| 5,080,266 | 1/1992 | O'Neill | 222/635 |
| 5,415,329 | 5/1995 | Westlund | 222/400.7 X |

FOREIGN PATENT DOCUMENTS

| | | | |
|---|---|---|---|
| 697359 | 11/1964 | Canada | 222/400.7 |

OTHER PUBLICATIONS

U.S. application for registration of Trademark SURE SHOT, Serial No. 280565, filed Oct. 6, 1980.

Advertising Brochure for Milwaukee Sprayer Manufacturing Co., Inc., CAT–90.

*Primary Examiner*—Joseph Kaufman

*Attorney, Agent, or Firm*—William W. Haefliger

[57] ABSTRACT

A sprayed liquid dispensing apparatus which comprises a container consisting of high-strength synthetic resin, the container having a bottom wall, an upright side wall, and an upper neck; the side wall including upper and lower wall portions having threaded interconnection, whereby the upper wall portion is rotatably removable from the lower wall portion to allow liquid to be filled into the lower portion, after which the upper portion is rotatably connectible to the lower portion to provide a sealed interconnection therewith; a pressurized gas inlet fitting carried by the upper wall portion proximate the neck, the fitting including a check valve, whereby pressurized gas can be filled into the container, for pressurizing the liquid therein; and a manually manipulable discharge valve carried proximate the top of the container, above the neck and via which sprayed liquid is dispensed; the side wall and bottom wall having sufficient thickness as to be rigid and to contain fluid pressure up to at least about 200 psi.

9 Claims, 2 Drawing Sheets

100
10
26
50
30
48
40
39
41
36
43
37
23
42
15
23a
14a
28
14aa
11
27
38
19
22
24
23b
17
21
31
18
34
16
34
25
12
14b
14
35
33
13
20

SPRAYED LIQUID DISPENSING APPARATUS

This application is a continuation-in-part of Ser. No. 29/013,959 filed Oct. 7, 1993 now U.S. Pat. No. Des. 357,177.

BACKGROUND OF THE INVENTION

This invention relates generally to liquid dispensing apparatus, and more particularly to improvements in sprayed liquid dispensing apparatus, wherein multiple advantages are achieved, as will appear.

There is need for lightweight, refillable, plastic containers to which pressurized gas of acceptable composition may be supplied. This avoids the need for finger pumping of liquid containers, to develop pressure for spraying purposes; and it also avoids any need for use of pressurizing gas of unacceptable composition. Also, there is need for containers for such liquid and acceptable gas under pressure, which are not metallic. In the past, commercially usable, handheld plastic containers were not able to contain gas pressures above levels of about 100 psi, due to their inadequate strength. It was believed that handheld plastic containers would have to have wall thicknesses of unacceptably large dimensions to contain such high pressures, such large dimensions being considered unacceptable, due to high cost of materials and to disposal problems after use.

There is need for containers which overcome the above problems and difficulties.

SUMMARY OF THE INVENTION

It is a major object of the invention to provide improved apparatus, as referred to, which overcomes the above problems, and which provides unusual advantages in construction, modes of operation, and results.

Basically, the apparatus of the invention comprises:

a) a container consisting of high-strength synthetic resin, the container having a bottom wall, an upright side wall, and an upper neck, b) the side wall including upper and lower wall portions having threaded interconnection, whereby the upper wall portion is rotatably removable from the lower wall portion to allow liquid to be filled into the lower portion, after which the upper portion is rotatably connectible to the lower portion to provide a sealed interconnection therewith, c) a pressurized gas inlet fitting carried by the upper wall portion proximate the neck, the fitting including a check valve, whereby pressurized gas can be filled into the container, for pressurizing the liquid therein, d) and a manually manipulable discharge valve carried proximate the top of the container, above the neck and via which sprayed liquid is dispensed, e) the side wall and bottom wall having sufficient thickness as to be rigid and to contain fluid pressure up to at least about 200 psi.

Typically, the container side wall thickness throughout the major length of the container below the container neck is between about 0.200 and 0.175 inches; and it has been found that a high-strength container capable of safely containing the fluid pressure up to 200 psi may be provided where the synthetic resin consists of polybutylene terephthalate. Such resin is sold under the name G E VALOX and BASF ULTRADUR. In this regard, the removable upper portion of the container carrying the inlet fitting and the discharge valve may desirably have somewhat greater wall thickness for added safety, the amount of added synthetic resin being minimal, since the major length lower portion of the container has the lesser wall thickness, as referred to.

Another object includes the provision of an inlet fitting that includes a tubular stem, the container upper wall portion defining an opening receiving the stem, and the fitting also including a flange connected to the stem, and located at the inner side of the upper wall portion, the flange having a size larger than the size of the opening, thereby to block outward displacement of the fitting through the opening. The fitting is carried by the container upper side wall section having an annular portion typically tapering toward the neck, whereby the fitting, which juts outwardly, is protectively located inwardly of a cylinder defined by the elongated lower portion of the container. This facilitates safe side-by-side stacking of such containers.

Yet another object includes the provision of a cap on the container having removable connection to the container above the neck, the discharge valve carried by the cap. As will appear, the cap includes an annular flange outwardly overhanging the neck, there being an annular retainer, the retainer and the container having threaded interconnection. The cap typically defines a downwardly re-entrant recess, inwardly of the annular flange, the discharge valve having a manually deflectable part protectively extending in the re-entrant recess. Filling of liquid into the container is carried out without removing the retainer and cap from the container.

These and other objects and advantages of the invention, as well as the details of an illustrative embodiment, will be more fully understood from the following specification and drawings, in which:

DRAWING DESCRIPTION

FIG. 1 an elevation showing the container apparatus;

FIG. 2 a vertical section taken through the FIG. 1 apparatus; and

FIG. 3 is a top plan view taken on lines 3—3 of FIG. 2.

DETAILED DESCRIPTION

Figure 1:
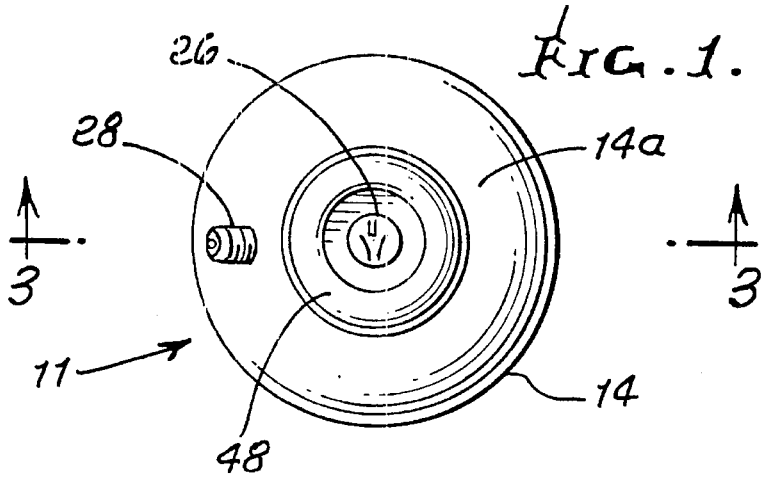
Figure 2:
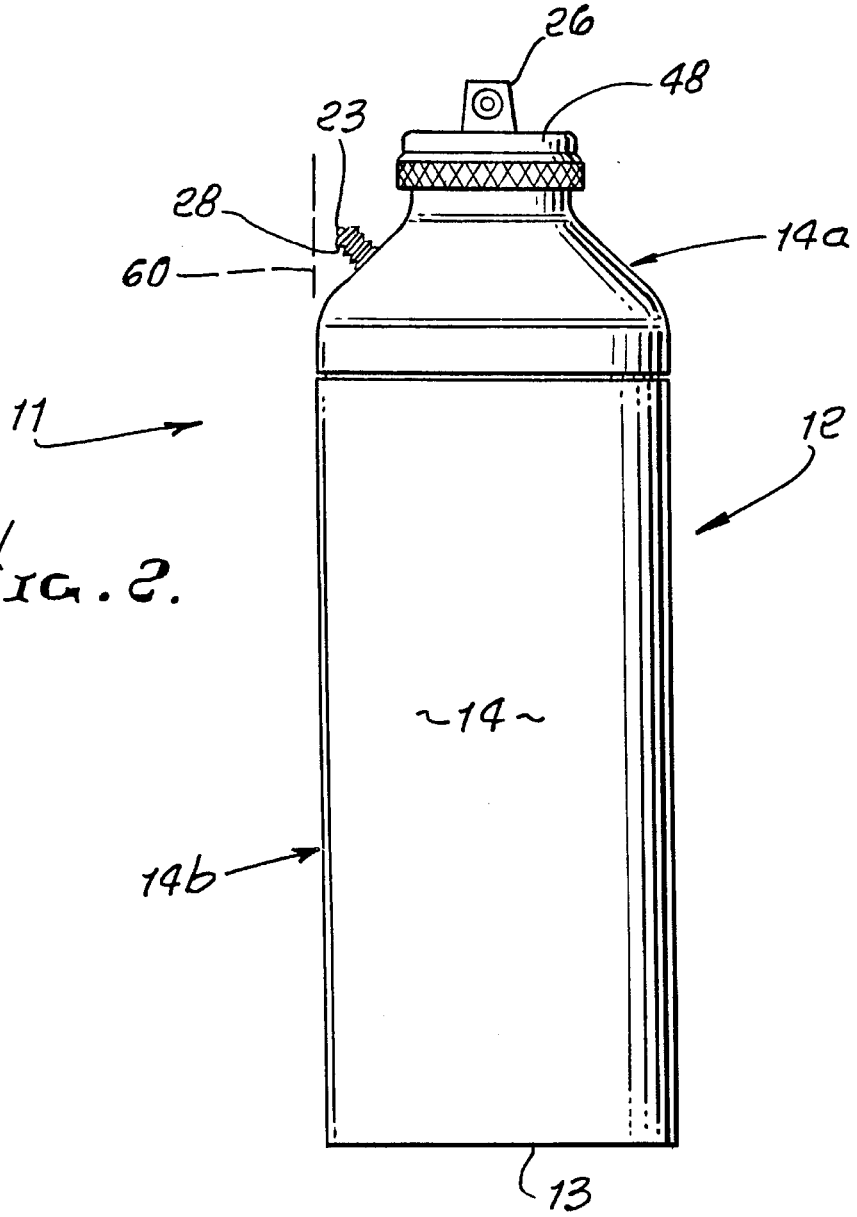

In the drawings, the apparatus for dispensing liquid as a spray 10 is shown generally at 11. It includes a container 12 consisting of high-strength synthetic resin molded into container shape. The container is of sufficient thickness as to be rigid, and to safely contain fluid pressure up to at least about 200 psi, although in use, typically pressure therein will be within the range 125–175 psi. It has been found that a synthetic resin consisting of polybutylene terephthalate satisfies these requirements.

The container has a bottom wall 13, a side wall 14, which is typically cylindrical, and a reduced diameter upper neck 15. The side wall includes upper and lower wall portions **14*a* and 14*b*, portion 14*a* tapering upwardly at 14*aa* to merge with the neck. The wall thickness of the upper wall portion 14*a* is typically somewhat greater than the wall thickness of the lower wall portion 14*b* and is typically 25–50% greater than the lower wall portion thickness; however, the upper wall portion has height typically less than 40% of the height dimension of the lower wall portion. This provides for in-fill of liquid 35 into the lower portion of the container to a level such as indicated at 16, to be sprayed from the container under pressure. Level 16 is greater than 50% of the height of the container lower portion 14*b*. The wall thickness of container lower portion 14***b* is between 0.175 and 0.200 inches, and preferably about 0.187 inches.

The upper and lower wall portions have threaded interconnection, whereby the upper wall portion is rotatably removable from the lower wall portion to allow sprayable liquid to be filled into the lower portion, after which the upper portion is easily rotatably connectible to the lower portion to provide a sealed interconnection therewith. See for example the external threads 17 on the lowermost extent of the upper wall portion 14*a*, and the screw threads 18 on the inner side of the uppermost extent of the lower wall portion 14*b*.

An annular O-ring 19 extends about the axis 20 of the container and is clamped between the upper and lower wall portions 14*a* and 14*b* when they are assembled together by relative rotation to interengage the screw threads. See clamping shoulders 21 on the container upper portion 14*a*, and 22 on the container lower portion 14*b*, shoulder 21 facing downwardly to interengage the O-ring and shoulder 22 facing upwardly to interengage the O-ring, the latter, for example, consisting of elastomeric material.

A pressurized gas inlet fitting 23 is carried by the upper wall portion 14*a*, and typically by the upwardly tapering portion 14*aa*, as referred to above, whereby the fitting is located proximate the neck 15. It includes a check valve generally indicated at 24 to allow air pressure (or other gas pressure) to be supplied inwardly through the tubular fitting into the space 25 above the liquid 35, but to block outward escape of such contained air pressure. Such pressure is sufficient to drive all of the liquid 35 from the container as spray 10 without requiring further pressurization of air or other gas into space 25.

After the container has been emptied of liquid, and remaining air pressure in the container has been allowed to escape via the valve 23, as by depressing a stem 23*a*, the container may be opened by unthreading of the upper portion 14*a* from the side wall lower portion 14*b* to allow in-fill of more liquid, after which 14*a* and 14*b* are reassembled, and air pressure is again filled into the container via fitting 23. Such pressure may be from a regulated source, indicated at 100, whereby the pressure within the container does not exceed a predetermined upper level. Alternatively, a safety valve may be provided on the wall portion 14*aa*, or integrated with fitting 23, to allow escape of excess pressure should it occur within space 25. The projecting stem 28 is located within a cylinder 60 defined by side wall 14*b*.

Another safety feature comprises the inclusion of an integral flange, such as a metallic nut 23*b*, on the fitting 23, the flange located at the inner side of the upper wall portion 14*a*. The flange has a diameter or size larger than the bore diameter size of the opening 27 in the wall portion that receives the fitting stem 28, whereby the flange blocks outward displacement of the fitting through that opening. In this regard, the pressurized gas in space 25 exerts outward force against the fitting. Fitting 23 may incorporate a Schrader valve.

Figure 3:
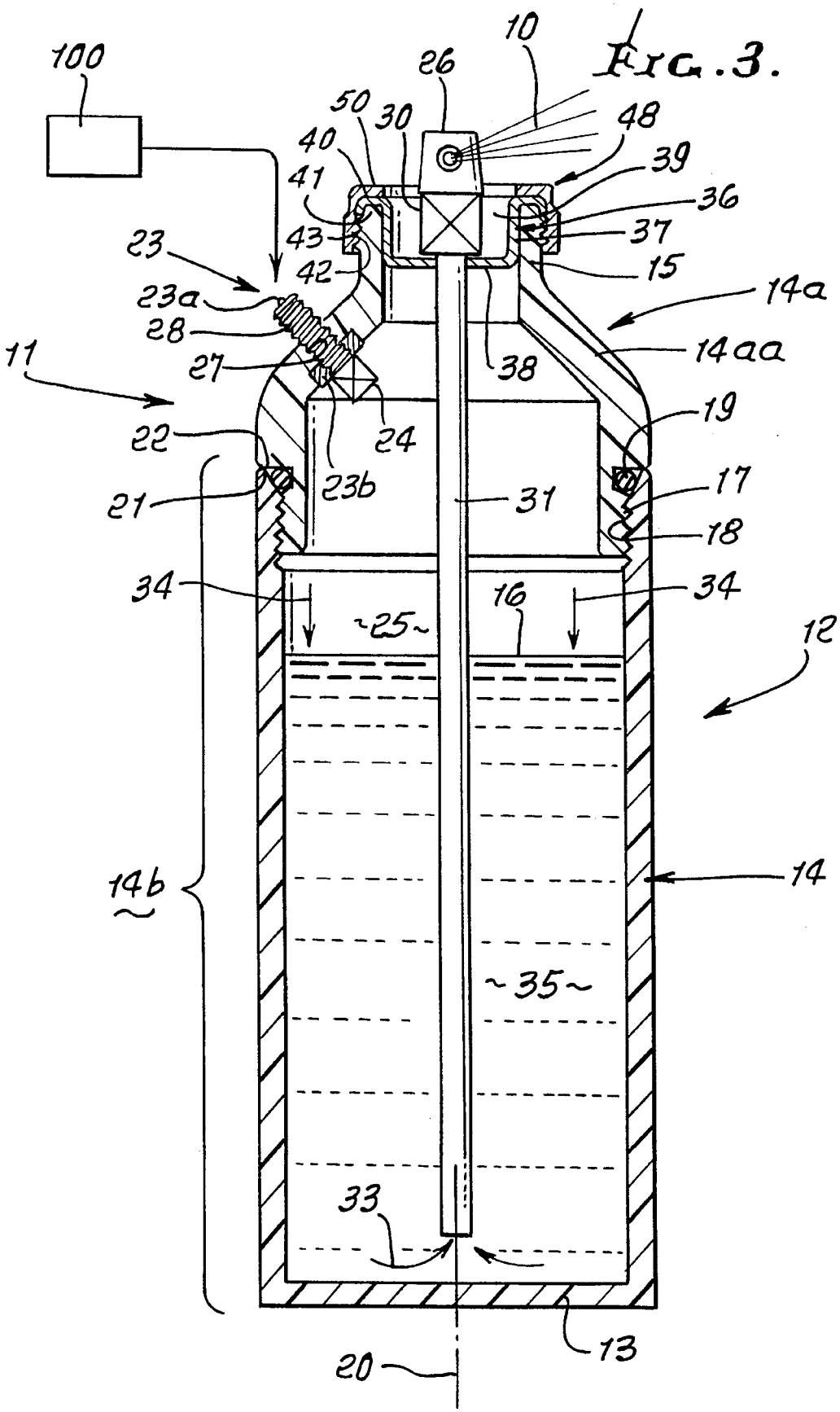

A manually manipulable discharge valve, generally indicated at 30, is carried proximate the top of the container, as for example at or above the neck 15. That valve is manipulable by manual manipulation of the nozzle 26 to tilt the latter or to depress the latter, which motion serves to open the valve 30, the valve closing when nozzle 26 is released. Such valves and nozzles are known. Liquid to be sprayed is supplied upwardly to the valve 30 via an elongated tube 31 extending downwardly in the container from the valve into the liquid 35, as for example is shown in FIG. 3.

Arrows 33 indicate the flow of liquid into the lower end of the tubing 31 under pressure of gas exerted on the liquid, as indicated at arrows 34.

The valve 30 is carried by a part 36, in the form of a cap, which has removable connection to the container above the neck. The cap may consist of metal; and it includes a side wall 37 and a bottom wall 38, together forming a re-entrant recess 39 within which the valve 30 is protectively received. The cap also includes an annular flange 40 outwardly of recess 39 and annularly overhanging the uppermost rim 41 of the neck 15, to form a seal therewith when the flange is pressed downwardly. An annular retainer 48 supplies downward pressure to flange 40 as the retainer is rotatably tightened downwardly on the neck. See interengaged threads at 42 and 43 via which the retainer is tightened and held downwardly to clamp the flange 40 for providing the seal, as referred to. The retainer has a lip 50 overhanging the flange, as shown. This construction allows for ready access to nozzle 26 and to recess 39, and for quick removal of 26, 30 and 31, and their replacement, if needed.

The following are summarized advantageous features of the invention:

1) quick, easy unscrewing of retainer
2) removable dome 14*aa* for ease of filling;
3) large upwardly opening bottom section or portion 14*b* for easy filling;
4) inside bottom fill line at 16 for ease of filling;
5) pressure up to about 180 to 200 psi;
6) Schrader valve inserted from inside dome 14*aa* (safety);
7) aerosol-type valving at 26 and 30;
8) valving 26 and 30 can be quickly and easily replaced;
9) spray pattern 10 can be varied;
10) wet or dry spray is enabled (fogging);
11) FDA and UDSA approved container wall compound (plastic);
12) unit can be easily depressurized (Schrader valve);
13) container can be pressurized with compressed air or bicycle pump;
14) side wall thickness of container can be varied (family of different size cans);
15) container can be of different colors;
16) container has two-piece construction—top and bottom joined by thread (internal and external mating thread);
17) O-ring seal 19 provided between upper and lower sections 14*a* and 14*b*:
18) eliminates need for disposal of multiple, no-refill conventional aerosol products;
19) uses ordinary air for pressurization;
20) location of Schrader valve is such that it cannot be damaged;
21) composition of plastic wall withstands harsh chemicals;
22) threads between portions 14*a* and 14*b* provide for four complete turns to disconnect; and after one complete turn the O-ring is released, letting air out for safety before complete disconnect;
23) all elements are replaceable;
24) no required disposal of hazardous or other chemicals;
25) bottom wall has recess—will not slide (safety).

We claim:

1. Sprayed liquid dispensing apparatus comprising:

a) a container consisting of high-strength synthetic resin, the container having a bottom wall, an upright side wall, and an upper neck, b) said side wall including upper and lower wall portions having threaded interconnection, whereby the upper wall portion is rotatably removable from the lower wall portion to allow liquid to be filled into the lower portion, after which the upper portion is rotatably connectible to the lower portion to provide a sealed interconnection therewith, c) a pressurized gas inlet fitting carried by said upper wall portion proximate said neck, the fitting including a check valve, whereby pressurized gas can be filled into the container, for pressurizing the liquid therein, d) and a manually manipulable discharge valve carried proximate the top of the container, above said neck and via which sprayed liquid is dispensed, e) said side wall and bottom wall having sufficient thickness as to be rigid and to contain fluid pressure up to at least about 200 psi.

2. The apparatus of claim 1 wherein said side wall has thickness throughout its major length below said neck between about 0.200 and 0.175 inches.

3. The apparatus of claim 2 including rotatably interconnectible threading at a lower end extent of said side wall upper section and at the upper end extent of said side wall lower section.

4. The apparatus of claim 1 wherein said synthetic resin consists of polybutylene terephthalate.

5. The apparatus of claim 1 wherein said inlet fitting includes a tubular stem, said container upper wall portion defining an opening receiving said stem, and said fitting also includes a flange connected to the stem, and located at the inner side of said upper wall portion, said flange having a size larger than the size of said opening, thereby to block outward displacement of the fitting through said opening.

6. The apparatus of claim 1 wherein said container side wall upper section has an annular portion tapering toward said neck, said inlet fitting located on said tapering portion to be spaced upwardly from a cylinder defined by said side wall below said upper section.

7. The apparatus of claim 1 including a cap on the container having a removable connection to the container above said neck, said discharge valve carried by said cap.

8. The apparatus of claim 7 wherein said cap includes an annular flange outwardly overhanging said neck, there being an annular retainer, the retainer and the container having threaded interconnection.

9. The apparatus of claim 8 wherein said cap defines a downwardly re-entrant recess, inwardly of said annular flange, said discharge valve having a manually deflectable part protectively extending in said re-entrant recess.

* * * * *